United States Patent [19]

Minorikawa et al.

[11] Patent Number: 4,667,463

[45] Date of Patent: May 26, 1987

[54] PROCESS AND APPARATUS FOR MAKING FASCIATED YARN

[75] Inventors: Koich Minorikawa; Shinichi Kitazawa, both of Otu, Japan

[73] Assignee: Toray Industries, Inc., Tokyo, Japan

[21] Appl. No.: 354,379

[22] Filed: Mar. 3, 1982

Related U.S. Application Data

[62] Division of Ser. No. 24,003, Mar. 26, 1979, Pat. No. 4,356,690.

[30] Foreign Application Priority Data

Mar. 24, 1978 [JP] Japan ..... 53-32950
Mar. 24, 1978 [JP] Japan ..... 53-32951
Jun. 8, 1978 [JP] Japan ..... 53-69050

[51] Int. Cl.[4] ..... D01H 5/28; D01G 1/06; D01G 1/08

[52] U.S. Cl. ..... 57/328; 19/0.39; 19/0.46; 19/0.58; 28/240; 28/245; 57/200; 57/210; 57/243

[58] Field of Search ..... 57/200, 210, 252, 243, 57/255, 256, 224, 207, 328, 350, 315, 310; 19/0.3, 0.62, 0.41, 0.35, 0.39, 0.48, 0.6, 0.46, 0.37, 0.56, 0.58, 244, 247, 248, 258, 260; 28/240, 245, 246

[56] References Cited

U.S. PATENT DOCUMENTS

| | | | |
|---|---|---|---|
| 2,230,399 | 2/1941 | Brandt et al. | 19/244 X |
| 2,388,760 | 11/1945 | Noguera | 19/258 |
| 2,611,931 | 9/1952 | Wildbolz | 19/0.48 X |
| 2,771,639 | 11/1956 | Aymerich | 19/258 X |
| 2,784,458 | 3/1957 | Preston | 19/0.41 |
| 2,797,444 | 7/1957 | Takagi et al. | 19/0.41 |
| 2,869,972 | 1/1959 | Head et al. | 8/130.1 |
| 2,908,043 | 10/1959 | Whitney | 19/0.6 |
| 2,920,176 | 1/1960 | Jorgensen | 219/19 |
| 2,941,259 | 6/1960 | Lohrke, Jr. | 19/0.46 X |
| 3,077,004 | 3/1956 | Mummery | 18/48 |
| 3,079,746 | 3/1963 | Field, Jr. | 57/328 |
| 3,303,169 | 2/1967 | Pitzl | 260/78 |
| 3,339,237 | 9/1967 | Chezaud et al. | 19/0.35 |
| 3,377,663 | 4/1968 | Arai et al. | 19/0.39 |
| 3,439,385 | 4/1969 | Weathers, Jr. | 19/0.35 |
| 3,516,241 | 6/1970 | Nakano et al. | 19/0.35 X |
| 3,770,866 | 11/1973 | Sakata et al. | 264/290 |
| 3,878,178 | 4/1975 | Guinn et al. | 260/79.3 |
| 4,003,194 | 1/1977 | Yamagata et al. | 57/328 |
| 4,080,778 | 3/1978 | Adams et al. | 57/350 X |
| 4,107,827 | 8/1978 | Sasshofer et al. | 28/246 |

*Primary Examiner*—John Petrakes
*Attorney, Agent, or Firm*—Austin R. Miller

[57] ABSTRACT

A process and apparatus are provided for manufacturing a fasciated yarn having uniform yarn construction and high strength. The process comprises subjecting fibers to a draft cutting step, at least one amendatory draft cutting step and a yarn formation step wherein the fibers are continuously transferred from the draft cutting step to the yarn formation step without any substantial interruption of fiber movement between the steps. The apparatus comprises a draft cutting zone comprising spaced sets of rolls through which fibers are conducted for subjecting the fibers to a draft cutting step, means forming a further draft cutting zone downstream of the aforesaid zone for subjecting the draft cut fibers to at least one amendatory draft cutting step, and a yarn forming means downstream of the amendatory draft cutting zone for subjecting the resulting fibers to a yarn formation step and transfer means between the zones whereby the fibers are continuously transferred from the draft cutting zone to the yarn formation zone without any substantial interruption of fiber movement between the zones.

38 Claims, 15 Drawing Figures

PROCESS AND APPARATUS FOR MAKING FASCIATED YARN

This is a division of application Ser. No. 24,003, filed Mar. 26, 1979 now U.S. Pat. No. 4,356,690.

The present invention relates to a process and apparatus for manufacturing a fasciated yarn and, more particularly, to a process and apparatus for manufacturing a fasciated fiber yarn of a special type having high strength wherein a plurality of wrapper fibers are formed around a core bundle of fibers.

As utilized in the description of this invention, the term "wrapper fibers" refers to those fibers which are wound around, and thus fasciate, the bundle of fibers which constitutes the core of the fasciated fiber yarn.

Still more particularly, the present invention provides a high-speed manufacturing method, with exceedingly high productivity, which produces fasciated fiber yarn in a single process continuously from synthetic fiber tow. This invention also provides unique uniformly draft cut sliver having unexpected advantages for the production of fasciated fiber yarn.

BACKGROUND OF THE INVENTION

Methods of manufacturing yarn without applying true twist have many advantages over conventional methods of spinning wherein true twist is applied. Typical examples include those in which fibers are wound around a core bundle by false twisting them with a fluid, those in which fibers are interlaced by the utilization of currents of fluid, and those in which a yarn is formed by bonding fibers with a binder. Such procedures permit high productivity from a high-speed operation, reduce the number of manufacturing procedures and provide ease of operation of equipment. Further advantages include the capability of producing the final yarn package with no rewind and direct delivery of finished yarns in large packages. Such systems realize large savings in energy and have other advantages as well. Vigorous efforts are being made in many quarters for the further development of such methods.

However, the yarn having properties most similar to conventional true twist yarn is the fasciated fiber yarn which has a core comprising a bundle of virtually non-twisted fibers—mainly staple fibers—and which has staple fibers wound around the surface of the bundle of core fibers. In the United States, such yarn has been placed into production on a commercial basis under the trade name "ROTOFIL".

Problems and limitations have heretofore been encountered in manufacturing such fasciated fiber yarn. Difficulties have arisen in transmitting, at the outlet of the draw zone, fibers floating around the bundle of fibers but which are intended to become the wrapper fibers. Problems have also arisen with respect to the properties required of slivers, the requisite of the means for forming the yarn, and so forth.

Also, the strength of true twist yarns, in general, exceeds that of known fasciated yarns, which in turn exceeds the strength of open-end spun yarns. (See the report of Symposium International Recherches Textiles Cotonnieres"—in Paris, April, 1969, pp. 249-265; the "Textile Industry", November, 1972, etc.).

Typical U.S. Patents disclosing methods of making fasciated yarn include those to Field No. 3,079,746, Yamagata et al No. 3,978,648 and Yamagata et al No. 4,003,194, the latter two being assigned to the assignee hereof. The former Yamagata et al patent discloses a means for transmitting the peripheral fibers, utilizing a conveyor apron band which causes the peripheral fibers to wrap the core fibers in an effective and orderly manner. The Field patent discloses an aspirator as a means of transmission.

In known fasciated fiber yarns the non-twisted core bundle of fibers assumes a more or less zigzag form by reason of the twist shrinkage of the wrapper fibers themselves. Even then the strength of the fasciated fiber yarn has been found to be somewhat less than that of ring spun yarns. The wrapper fibers of known fasciated yarns have sometimes tended not to form or to form irregularly, creating yarn portions wherein the wrapper fibers did not have enough strength to fasciate the core bundle of fibers, thus causing yarn breakage by fiber slippage under high tension.

It has been found that formation of such faulty yarn portions may be attributed to several occurrences in the draft zone. One typical example is the presence of fibers floating around the bundle of fibers, that is, the fibers which are intended to become the wrapper fibers are blown off due to some external factor such as turbulent flow of air. As another example, the air jetting holes of the false twist air vortex nozzle becomes clogged in a manner to inhibit their twist-imparting capability. As a still further example, sufficient means are not provided for transmitting and applying the wrapper fibers to the core fibers.

It is an object of this invention to provide a fasciated fiber yarn producing method which overcomes this problem. Still another object is to bring the strength of the fasciated fiber yarn up to the level of ring spun yarn.

In conventional processes, drawing was carried out by the wet process, using steam or hot water. While this permitted relatively uniform drawing, it required large-scale drying equipment in order to reduce tow water content after drawing below 1 to 2 percent, requiring high equipment cost and consuming considerable energy for drying. From the economic viewpoint, it was necessary to make the tow as heavy as several hundred thousand to several million denier. However, it is then necessary to conduct many tow processing steps to obtain roves of proper thickness for making yarns, so that even though once uniform tows are products, the uniformity of it is disturbed and neps or slubs appear, leading to the lowering of uniformity of tows; and, besides, the complexity of these added process steps makes the yarns produced very expensive. The alternatives was to use undrawn tow of lower denier but then the productivity was extremely low and the manufacturing cost was very high.

There have heretofore been many attempts using both wet and dry processes to eliminate such drawbacks, wherein undrawn uniform tow is drawn and is then continuously subjected to one draft cutting operation and then to another draft cutting operation, in an attempt to obtain uniform sliver.

In wet process drawing of this type it was difficult to dry the tow well enough and this created draft cut irregularities; hence, it was difficult to obtain uniform silver or to obtain high strength fasciated fiber yarn.

In the dry process using hot plates, it is impossible to carry out uniform drawing of undrawn tow heavier than tens of thousands of denier and, hence, to carry out uniform draft cutting. Therefore, draft cut irregularities occur and single yarns break off and wind over the roller.

It has now been discovered that, even with the dry process, it is possible to obtain uniform tow of high quality by special dry heat drafting. By draft cutting using this tow, it is possible to obtain uniform sliver of high strength, quality and uniformity.

It is a still further object of this invention to overcome the drawbacks which have hitherto been found with fasciated fiber yarn and to provide a novel and very special type of fasiciated fiber yarn which has the advantageous properties of true-twist yarn or even better.

BRIEF DESCRIPTION OF THE INVENTION

It has now surprisingly been discovered that the distribution of fiber lengths of the sliver supplied to the yarn forming process in the fasciated fiber yarn spinning process must be sharply different from that usually employed in conventional spinning processes. Considerable studies have been undertaken regarding the relationship between the staple fiber length distribution for fasciated yarn spinning in relation to the quality of the yarn produced. As a result, it has been discovered that the use of sliver having a very special staple fiber length distribution produces highly advantageous and highly unexpected results.

In order to establish a highly-efficient and highly-productive method of spinning fasciated yarn important relationships between each spinning system and the process of making sliver by draft cutting synthetic fiber tow have been discovered. As a result, it has become clear that, when making sliver by draft cutting synthetic fiber tow, it is essential that uniformity of tow be ensured as well as that of sliver. It has been discovered that surprising results are obtained by producing uniform tow by drawing undrawn or partially drawn two of synthetic fibers under special conditions, that is, in such a manner that in the draw zone the necking points of all the fibers are always distributed within a certain fixed range, and in subsequently obtaining admirably uniform draft cut sliver by subjecting the thus obtained drawn tow to a draft cutting process under special conditions.

Accordingly, it has been discovered that two basic principles as regards fasciated fiber yarns exist:

1. In the draft zone floating fibers are more likely to become the wrapper fibers, especially when most of the fibers have a fiber length of less than $\frac{1}{2}\bar{l}$, wherein $\bar{l}$ is substantially the average fiber length.

2. The greater the length of the fibers, the less the chance of yarn breakage by fiber slippage under high tension, and the greater the strength of the yarn.

In the general principles of spinning, however, these two phenomena, (1) and (2), are contradictory; that is, if it is tried to produce more floating fibers, this results in deterioration of the quality of yarn from draft irregularities; and if it is tried to make the length of fibers greater, this results in decrease in production of floating fibers, namely, the wrapper fibers, as well as in irregular drawing owing to the existence of overflow fibers.

It has surprisingly been discovered that it is possible to obtain a fasciated fiber yarn of a superior quality, which can stand comparison with ring spun yarn in all respects of properties, by creating a product wherein (the component fibers having a mean length expressed by the symbol $\bar{l}$) there exist more than 15 percent each of fibers shorter than $0.5\times\bar{l}$ and of fibers longer than $1.5\times\bar{l}$, thereby ensuring an effective formation of the wrapper fibers and of the maintenance of high strength in the yarn produced.

To obtain a fasciated fiber yarn of superior quality, a sliver is made having a special staple length distribution, and is direct fed to the means for forming the yarn. In accordance with this invention the draft cutting conditions are critically regulated to positively and concurrently produce significant quantities of both extremely long and extremely short fibers.

In the fasciated yarn spinning process of this invention the tow is first subjected to a draft cutting operation and then to an amendatory draft cutting operation in one or more stages, and is thereafter continuously supplied to the yarn forming zone. This occurs virtually without interruption of the flow of the bundle of fibers. The amendatory draft cut ratio of the amendatory draft cutting zone is maintained above about 2.5. Further, the amendatory draft cutting gauge of the said zone is maintained at about 0.4 to 0.9 times as large as the draft cutting gauge of the draft cutting zone, or of the amendatory draft cutting zone immediately upstream of the amendatory draft cutting zone in question. In such a manner short floating fibers, which serve effectively as the wrapper fibers, are formed around the periphery of the bundle of fibers. On the other hand, long fibers are produced which impart strength by forming the core of the fasciated fiber yarn. If the said amendatory draft cut ratio is less than about 2.5, effective formation of peripheral fibers is not achieved.

It has been found that if the movement of the bundle of fibers is interrupted between draft cutting, amendatory draft cutting and yarn forming, that is, if the bundle of fibers from one step is rolled up or put into a sliver can before being supplied to the next step, it is rather difficult to obtain uniform sliver without disturbance from handling. Therefore, it is important to obtain uniform draft cut sliver and to transmit it continuously to the next process step without impairing the uniformity of the sliver.

While uniform tows may be prepared in a separate process before they are supplied to the draw cutting zone, thereafter being processed in a continuous method, better results are obtained by providing a draw zone just upstream of the draft cutting zone. Undrawn or partially drawn tow which is virtually free of twist is properly regulated in thickness and width and then drawn in said draw zone. This drawn tow, which is in the form of sheet with uniform thickness is continuously supplied to the draft cutting zone while maintaining tension on the tow after drawing and with little or no change in width.

It is then subjected to the draft cutting process under conditions previously described. In this way, the occurrence of miscuts from entanglement of the bundle of fibers in the draft cutting zone or the amendatory draft cutting zone is prevented and formation of short and long fibers in a normal condition is ensured. Thus, irregularities of the wrapper fibers owing to an abnormal distribution of the length of fibers are eliminated and uniform fasciated fiber yarns are produced. The resulting fasciated fiber yarns are resistant to breakage under tension and are practically free of flaws such as slubs.

The present invention adopts, as the most preferable mode of processing, a method wherein undrawn or partially drawn tow is used as the starting material and processed in a single process without interruption of the movement of the bundle of fibers during the operation. The use of undrawn or partially drawn tow as the starting material has many advantages over the use of drawn tow. Since the component fibers are relatively free of disorder, strain and tension variances, draft irregularities do not occur and tension remains even, thereby preventing concentrated fiber breakages. However, it is desirable to supply them in twistless and uniform ribbon form and to make them as uniform as possible.

The drawing conditions required for obtaining uniform drawn tow by drawing undrawn or partially drawn tow are highly important, as will appear in further detail hereinafter and in the drawings, of which:

Figure 1:
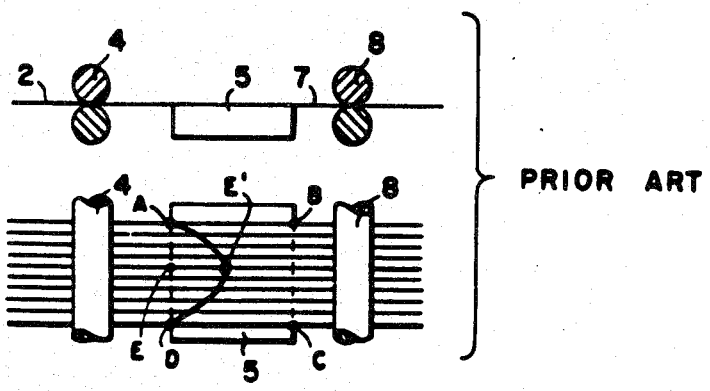
FIG. 1 is a pair of views, plan and side, schematically showing a draw zone of a conventional tow drawing process, showing a typical distribution of the individual drawing points of the fibers in the tow.

In the conventional process of dry heat drawing with hot plates, as shown in FIG. 1, an undrawn tow 2, fed by feed rollers 4 to the draw zone, contacts a hot plate 5 and is drawn as it is pulled out by the draw roller 8. In this instance, the drawing line, which is a row of drawing points on the hot plate, draws an arc AE'D in the direction of movement of the tow. This is because the layer of fibers of the tow is thicker toward the center and it therefore takes a longer time for the heat to reach the innermost layer of fibers.

In such a draw treatment where the drawing line draws an arc, a difference arises in the heat hysteresis between the border portions and the central portion of the tow. That is to say, when the tow is drawn, fibers at the borders, close to points "A" and "D" in FIG. 1, are subjected to sufficient heat setting between points "A" and "B" and between points "D" and "C". However, at the central part of the tow, the drawing point moves to E', hence such part of the tow, remaining in undrawn state, undergoes heat hysteresis only between points E and E'. The orientation of fibers of the tow in such undrawn state is extremely low. They are quite unstable under the influence of heat, and their physical properties change by a large measure once they undergo heat hysteresis. Accordingly, there is a wide variance in the physical properties of the tow. In particular, the elongation is very small at the central part of the resulting tow, and there is a tendency toward degradation.

Even if such tow having non-uniform physical properties were draft cut it would not be possible to obtain uniform silver. Dyeing specks and irregularities of strength are observed. Because of stress concentration in the area of low elongation the breaking points tend to concentrate at one place, thus resulting in excessive irregularities in the sliver produced. When such excessive concentrate fiber breakages occur it is not possible to continue the draft cutting process.

Figure 2A:
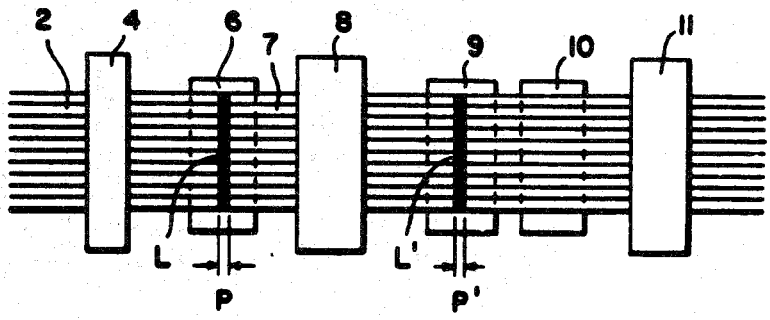
FIGS. 2A and 2B are schematic plan views of a draw zone comprising a component of the apparatus of this invention, illustrating a typical distribution of fiber drawing points attained.

It has been found necessary, when carrying out the dry heat drawing of undrawn or partially drawn tow of synthetic fibers, to prevent dispersions of the fiber drawing points. The drawing points of all component fibers must always be distributed within a certain narrow range. The drawing points should line up in a straight row (L') as shown in FIG. 2A at approximately a right angle to the direction of the movement of the tow. It is not necessary that the drawing points line up perfectly in a straight line, but it is desirable that the condition be so set as to distribute the drawing points within a certain fixed range "P" (FIG. 2A) of a narrow width of about 3 mm, for example. If the width of the range of fluctuations (P) remains below about 3 mm, the difference in the heat hysteresis is substantially negligible, and the drawing points are considered substantially in a straight line, as the term is used herein.

The draw treatment of this invention may be carried out in a single stage or in two or more draw stages.

In FIG. 2A undrawn tow of synthetic fibers is subjected to two-stage drawing by passing the fibers through a primary draw zone 4–8 provided with a heating device 6 and then through a secondary drawn zone 8–11 provided with two heating devices 9, 10, with the drawing points arranged substantially in a straight line P, P' in each of the draw zones. In this instance, the primary draw step is carried out at a heater setting of about 100° to 140° C. and at a draw ratio of about 85 to 95% of the maximum draw ratio which permits uniform drawing in the primary stage. The secondary draw step is carried out by running the tow in contact with the second zone upstream heater 9, which is heated to a temperature of about 130° to 170° C., in the secondary draw zone, with the draw ratio set at less than about 1.20 times. The tow is then subjected to a heat setting treatment under tension by the second zone downstream heater 10 which is heated to a temperature of about 170° to 230° C.

Figure 2B:
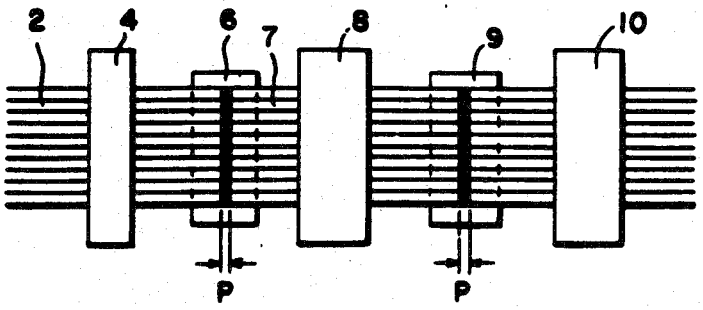

FIG. 2B shows two-stage drawing with heater 9 below and heater 10 above the tow.

Drawn tow thus obtained may be continuously supplied to the subsequent draft cutting operation, or may be stored in cans as a future supply.

Figure 3:
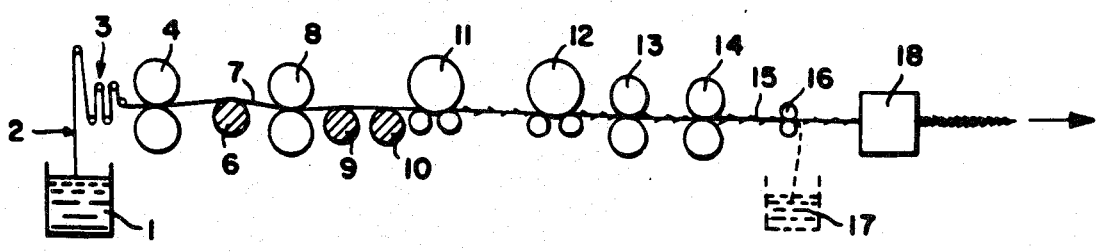
FIG. 3 is a schematic side elevation view of apparatus showing one embodiment of the present invention.

Referring to FIG. 3, an undrawn tow 2 consisting of polyethylene terephthalate fibers for example, from a tow can 1, passes through a tow regulating guide 3, and is processed into a sheet-like tow of uniform thickness. Such tow enters the first draw zone formed by feed rollers 4 and draw rollers 8. A draw pin 6, heated to about 100° to 140° C., contacts the drawn tow which is drawn at 7 by the rollers 8 which rotate at a higher speed than the feed rollers 4. The drawing points of the fibers are arranged virtually in a straight line on the pin 6, as heretofore described in connection with FIGS. 2A and 2B. Subsequently, the tow 7 enters the secondary draw zone formed by the draw rollers 8 and the second draw rollers 11 which rotate faster than rollers 8. In this secondary draw zone, there are provided two heating devices such as the second draw pin 9 and a heat setting pin 10. In this secondary draw zone, the tow contacts the second draw pin 9 heated to a temperature of about 130° to 170° C., and is drawn at a ratio below 1.20 with the drawing points arranged virtually in a straight line on said pin 9, thus undergoing the second stage of drawing. Tow 7 subsequently contacts the heat-setting pin 10 heated to a temperature of about 170° to 230° C., disposed immediately after said second drawing pin 9, and is subjected to a heat-setting treatment under even tension. Then the tow 7 is fed by the second draw roller 11 and is continuously supplied to the draft cutting zone, 11–12 without of the movement of the two and with the tension of the tow kept unaffected. In the draft cutting zone, the tow is draft cut by a draft cutting roller 12 which rotates at a high speed—about 1.8 to 10 times as high as that of the second draw roller 11.

The bundle of fibers which has thus been draft cut is subjected to an amendatory draft cutting operation and to a further draft cutting operation by amendatory draft rollers 13 and 14 of FIG. 3, and is thus made into a silver 15 having a predetermined distribution of fiber lengths and a predetermined sliver count. The sliver 15 is advanced by calender rollers 16, and is supplied to a yarn forming unit 18, the details which will appear further hereinafter. The sliver may, as occasion demands, be stored in a sliver can 17 as shown in FIG. 3.

Figure 4:
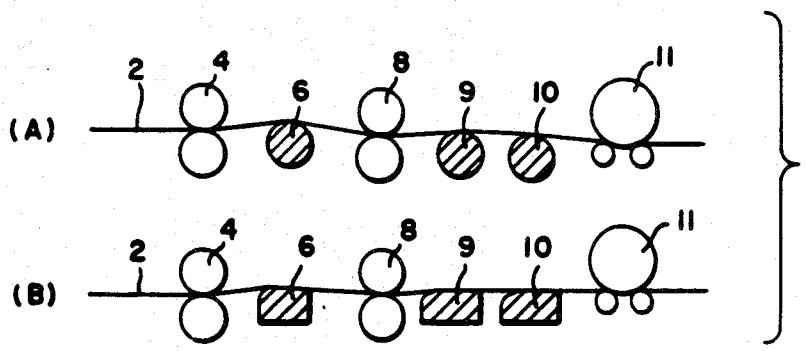
FIGS. 4A and 4B are schematic side elevation views of a draw zone, showing a further embodiment of the present invention.

It has been found that best results are obtained by providing a short heater contact length, as by using a heater in the shape of a heating pin having a diameter of 5 to 150 mm, preferably 40 to 100 mm, or a heating plate having a curved surface with a radius of curvature of about 2.5 to 75 mm, preferably 20 to 50 mm, where it contacts the tow, as shown in FIGS. 4(A) and 4(B). However, the second heating device 10 in the secondary drawing zone may as well be in the shape of an ordinary flat plate, as in FIG. 4(B), since its principal function is heat setting.

It is necessary to set the temperature of the heating device in the primary drawing zone 4–8 within a range of about 100° to 140° C. for polyethylene terephthalate fibers. If the temperature is lower than about 100° C., it becomes difficult to keep the drawing points arranged in a straight line. If the temperature is higher than about 140° C., irregularities occur in the sliver and operational efficiency is impaired.

Furthermore, it is necessary that the draw ratio in the first draw zone 4–8 be set at about 85 to 95% of the maximum draw ratio permitting uniform drawing. Otherwise it is difficult to obtain uniform sliver.

As used in this specification, the term "maximum draw ratio permitting uniform draw" means a value 0.95 times the natural undrawn ratio of the drawn row. The natural draw ratio is obtained from the formula:

$$\frac{E_1 + 100}{100}$$

wherein $E_1$ is elongation in the fiber strain zone under constant stress.

As used herein, the term "sliver I factor" is a value obtained by dividing the measured Uster evenness (U%) of a silver by the ideal Uster evenness (U%) of a perfectly uniform sliver. The "sliver I factor" is obtained from the following formula:

$$\text{Sliver I factor} = \frac{\text{Actually measured } U}{\frac{80}{\sqrt{q}}}$$

wherein "q" is the number of fibers at the cross section of the sliver and is determined by dividing the total denier of the sliver by the denier of a single fiber.

By combining the conditions described above it becomes possible to distribute the aforementioned fiber drawing points within a more or less straight, narrow range having a width of about 3 mm.

It has been found that there is an important relationship betwen the sliver "I" factor, which is a factor indicating the degree of uniformity of a sliver, and the value of the first draw ratio divided by the maximum first draw ratio. This appears in FIG. 5 of the drawings, which is based upon tests wherein twelve 75,000-denier undrawn tows of polyethylene terephthalate fiber were processed into sliver. The first draw temperature was 120° C., the second draw temperature was 150° C., the heat setting temperature immediately after the second draw was 210° C., the second draw ratio was 1.10 times, and the first draw ratio was varied in several ways.

Figure 5:
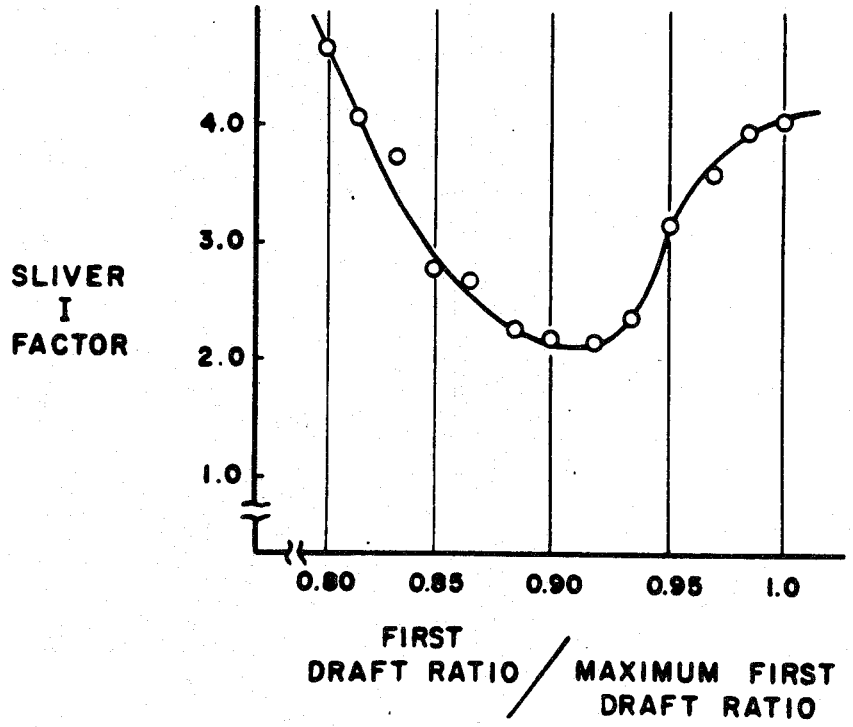
FIG. 5 is a graph showing a relationship between a draw ratio and a sliver I factor.

Referring to FIG. 5, when the first draw ratio divided by the maximum first draw ratio (the abscissa) is 0.85 to 0.95, a far superior sliver is obtained. Its sliver "I" factor is sharply lower than the "I" factor of conventional sliver which usually exceeds 4.0. When the FIG. 5 abscissa is about 0.87 to 0.93, the sliver has an "I" factor of about 2.1, and has very high quality, with only about half the irregularities found in conventional sliver.

According to the present invention, it is possible to obtain synthetic fiber slivers having an "I" factor of below about 3.0, thus by far excelling those hitherto known in the degree of uniformity.

In the method of the present invention, it is necessary to maintain the draw ratio in the second stage at less than about 1.20, preferably at about 1.02 to 1.10. If it exceeds about 1.20 draft cutting becomes rather difficult and the sliver "I" factor exceeds 4.0, thus making it impossible to obtain uniform silver.

Further, it is necessary to maintain the secondary draw temperature for polyethylene terephthalate at about 130° to 170° C. Outside this range the sliver "I" factor generally exceeds about 4.2, a very undesirable figure.

Still further, it is necessary, in the present invention, to subject the drawn tow, immediately after the secondary draw operation, to a heat-setting treatment under tension by the use of a heating device which is heated to a temperature in the range of about 170° to 230° C.

A particularly good result is obtained when the heating device 10 for said heat-setting treatment is so disposed that its upstream end lies at a distance of less than about 150 mm from the downstream and of the secondary heating device 9. This condition may be applied not only to polyester fibers but to polyamides as well.

The following examples are intended to be illustrative but not limitative of the scope of the invention, which is defined in the appended claims.

EXAMPLE 1

Twelve 70,000-denier undrafted tows of polyester fibers were processed into slivers with a thickness of 2.3 g/m under the following drafting conditions, viz.: first draft temperature=115° C.; first draft ratio=3.6 times, corresponding to 90% of the maximum first draw ratio; secondary draw ratio=1.15 times; secondary draw temperature=150° C.; and heat-setting temperature=210° C. This sliver had excellent uniformity, its "I" factor being 2.1.

Several further tests were made under different sets of conditions, viz.: in the first instance, the first draw ratio=3.28 times, corresponding to 82% of the maximum first draw ratio; with the other conditions the same as above. In the second instance, the first draw ratio=3.6 times, corresponding to 90% of the maximum first draw ratio; first draw temperature=150° C.; secondary draw ratio=1.20 times; secondary draw temperature=110° C., and heat-setting temperature=200° C. In the third instance, the first draw ratio=3.6 times; first draw temperature=90° C.; secondary draw ratio=1.31 times; secondary draw temperature=150° C.; and heat-setting temperature=190° C. In all these instances, the "I" factor exceeded 4.2, that is, it was impossible to obtain uniform slivers.

Even under conditions different from the foregoing, sliver having a sliver "I" factor below 4.0 is manufactured by drawing undrawn two with the drawing points arranged virtually in a straight line, thereby obtaining uniform tows, and by subjecting such tow to draft cutting process either continuously or non-continuously. The following is a description of such further technique.

With the drawing points arranged virtually in a straight line in each of two draw stages, the draw ratio in the first stage is maintained at 90 to 99% of the maximum draw ratio and that the total draw ratio which is the product of the draw ratio in the first stage and the draw ratio in the second stage, is maintained at 85 to 95% of the maximum total draw ratio, which is the product of the draw ratios in the first and second stages immediately before a single yarn breakage occurs by drawing under the given draw conditions in the first and second stages. This drawn tow is either stored in cans and supplied to the draft cutting process or is supplied continuously to the draft cutting process without interruption.

Figure 6:
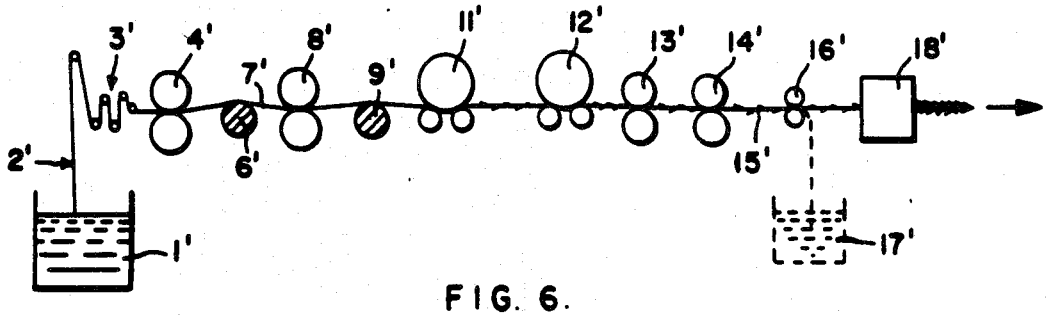
FIG. 6 is a schematic view in side elevation of apparatus showing another embodiment of the present invention.
Figure 7:
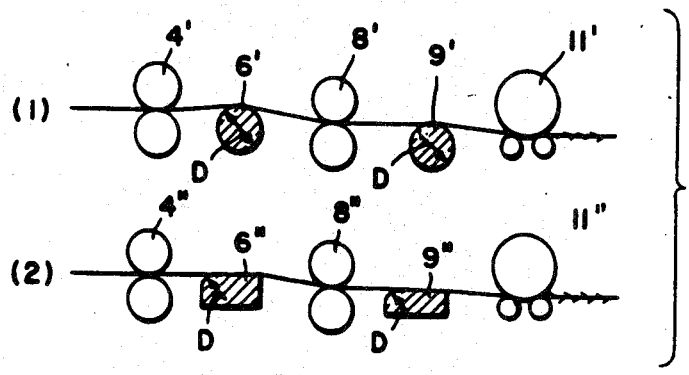
FIGS. 7(1) and 7(2) are schematic views in side elevation of a draw zone showing further embodiments of the present invention.

FIG. 6 is an example of the above mentioned procedure. Updrawn tow 2', from two can 1' and passed through tow regulating guide 3' is processed into a sheet-like tow of uniform thickness. Such tow is fed by feed rollers 4' to the first draw zone including draw pin 6' and draw rollers 8'. The drawing points are arranged in a more or less straight line on the pin 6' which is heated to above the second transition temperature of polyethylene terephthalate, preferably about 80° to 100° C. Subsequently, the tow is supplied to the secondary draw zone including secondary draw pin 9' and secondary draw rollers 11'. The tow contacts pin 9' which is heated to about 150° to 230° C., with the fiber drawing points arranged in a more or less straight line on the heated pin 9'. It is then continuously supplied to a draft cutting zone, while maintained under tension, and is subjected to the draft cutting process by draft cutting roller 12' which rotates at a speed about 1.5 to 9.5 times the speed of roller 11'. The draft-cut fibers are then subjected to an amendatory draft cutting operation (a further draft cut) by two sets of amendatory draft cutting rollers 12' and 13' and 13' and 14', and is thus made into a sliver 15' having a predetermined distribution of fiber lengths and a predetermined thickness. The sliver 15' is forwarded by calender rollers 16', and is supplied continuously to the yarn forming process 18', or may, as occasion demands, be stored in a sliver can 17'.

In the aforsaid process a particularly important point is to draw in each of the two stages so that each set of drawing points is arranged in a more or less straight line. The heating and draw-ratio conditions set forth in connection with the previous Example apply to this instance as well. The single fiber strength of a draft cut polyester sliver which underwent drawing and draft cutting under such drawing conditions is more than 7.0 g/d.

Tests were conducted with fifteen 70,000-denier undrawn tows of polyester fibers. The first draw temperature was 98° C.; the secondary draw temperature was 180° C.; and the first and secondary draw ratios were varied in several ways. Table 1 shows the results.

TABLE 1

| $d_1/d_1$ (max) | $d_f/d_f$ (max) | Sliver I factor | Tenacity of fiber in sliver | Elongation of fiber in sliver | Number of frame stoppages number/one frame/10 hrs. |
|---|---|---|---|---|---|
| 0.75 | 0.60 | 4.76 | 4.35 | 16.1 | 5.3 |
| | 0.65 | 4.58 | 4.34 | 16.0 | 3.9 |
| | 0.80 | 4.03 | 4.36 | 15.2 | 3.9 |
| | 0.83 | 3.98 | 4.88 | 14.3 | 4.2 |
| | 0.95 | 4.02 | 5.21 | 13.2 | 3.8 |
| | 1.00 | 4.14 | 6.39 | 13.0 | 2.7 |
| 0.80 | 0.60 | 5.50 | 4.40 | 16.0 | 1.3 |
| | 0.65 | 5.10 | 4.39 | 15.0 | 1.0 |
| | 0.80 | 4.08 | 4.53 | 14.3 | 1.0 |
| | 0.83 | 3.96 | 4.87 | 13.5 | 1.0 |
| | 0.90 | 3.85 | 5.00 | 13.1 | 1.0 |
| | 0.95 | 3.99 | 6.31 | 13.0 | 1.0 |
| | 0.97 | 4.12 | 6.32 | 12.8 | 1.1 |
| | 1.00 | 4.19 | 6.48 | 12.7 | 1.9 |
| 0.85 | 0.60 | 6.00 | 5.11 | 15.9 | 2.7 |
| | 0.65 | 5.28 | 5.32 | 13.9 | 1.1 |
| | 0.80 | 4.10 | 5.96 | 13.8 | 1.1 |
| | 0.83 | 3.98 | 6.43 | 11.8 | 1.0 |
| | 0.85 | 3.90 | 7.13 | 9.4 | 0.9 |
| | 0.95 | 4.01 | 7.28 | 9.3 | 1.0 |
| | 0.97 | 4.10 | 7.40 | 9.0 | 1.1 |
| | 1.00 | 4.26 | 7.63 | 9.1 | 2.3 |
| 0.90 | 0.60 | 6.55 | 6.48 | 10.7 | 1.9 |
| | 0.65 | 5.68 | 6.82 | 10.3 | 1.2 |
| | 0.83 | 3.92 | 6.98 | 10.2 | 1.0 |

TABLE 1-continued

| $d_1/d_1$ (max) | $d_t/d_t$ (max) | Sliver I factor | Tenacity of fiber in sliver | Elongation of fiber in sliver | Number of frame stoppages number/one frame/10 hrs. |
|---|---|---|---|---|---|
| | 0.85 | 3.96 | 7.36 | 9.3 | 1.0 |
| | 0.95 | 3.96 | 7.69 | 9.3 | 0.8 |
| | 0.97 | 4.13 | 7.70 | 9.1 | 0.9 |
| | 1.00 | 4.30 | 8.05 | 8.0 | 4.3 |
| 0.95 | 0.60 | 7.00 | 6.11 | 12.9 | 2.0 |
| | 0.65 | 6.22 | 6.15 | 11.5 | 1.1 |
| | 0.83 | 3.97 | 6.22 | 10.3 | 1.2 |
| | 0.85 | 3.89 | 7.03 | 9.4 | 0.9 |
| | 0.90 | 3.75 | 7.22 | 9.4 | 1.0 |
| | 0.95 | 3.97 | 7.64 | 8.9 | 0.8 |
| | 0.97 | 4.18 | 7.80 | 8.3 | 1.0 |
| | 0.98 | 4.25 | 7.99 | 8.2 | 1.2 |
| | 1.00 | 4.88 | 8.33 | 8.0 | 3.6 |
| 0.98 | 0.60 | 7.20 | 4.99 | 12.3 | 3.2 |
| | 0.63 | 6.72 | 6.06 | 11.2 | 3.5 |
| | 0.65 | 6.71 | 6.21 | 10.2 | 4.0 |
| | 0.75 | 5.08 | 6.53 | 9.9 | 1.1 |
| | 0.80 | 4.26 | 6.72 | 9.9 | 0.7 |
| | 0.83 | 3.95 | 6.99 | 9.6 | 0.8 |
| | 0.85 | 3.90 | 7.54 | 8.5 | 0.5 |
| | 0.90 | 3.60 | 8.01 | 8.2 | 1.0 |
| | 0.95 | 3.96 | 8.21 | 8.1 | 0.9 |
| | 0.97 | 4.20 | 8.19 | 8.0 | 1.1 |
| | 1.00 | 4.52 | 8.18 | 8.0 | 2.8 |
| 0.99 | 0.60 | 7.18 | 6.14 | 12.8 | 4.3 |
| | 0.70 | 6.00 | 6.55 | 10.4 | 1.0 |
| | 0.80 | 4.25 | 6.93 | 9.8 | 0.9 |
| | 0.90 | 3.52 | 8.01 | 8.1 | 1.0 |
| | 1.00 | 4.63 | 8.25 | 7.9 | 3.5 |
| 1.00 | 0.60 | 7.21 | 6.72 | 11.5 | 3.1 |
| | 0.70 | 6.25 | 6.75 | 11.0 | 0.9 |
| | 0.80 | 4.32 | 6.98 | 10.3 | 0.9 |
| | 0.90 | 3.51 | 8.34 | 7.9 | 1.0 |
| | 1.00 | 4.70 | 8.36 | 7.8 | 4.3 |

It is apparent from a careful examination of Table 1 that to obtain a sliver strength greater than 7.0 g/d, which is an aim of the present invention and which is much greater than that of conventional polyester staple fiber—in general, 5.0 to 6.5 g/d—it is necessary to meet the following conditions:

$$0.90 \leqq d_1/d_1(\max) \quad (1)$$

$$0.85 \leqq dt/dt(\max) \quad (2),$$

where $d_1$ means the first draw ratio, $d_1$ (max)" means the maximum first draw ratio, "dt" means the product of first and second draw ratios and "dt(max)" means the product of maximum draw ratios of the first and second stages. The expression "maximum draw ratio" means the highest possible ratio just before a single fiber break occurs under the existing temperature condition. Also, the degree of uniformity of the sliver is mainly influenced by the value of dt/dt (max); to obtain an "I" factor below 4.0, it is necessary to satisfy the following condition:

$$0.83 \leqq dt/dt\ (\max) \leqq 0.95 \quad (3)$$

In the next place, the frequency of undesired winding of broken fibers around the roller and the frequency of stoppages of the machine owing to non-uniformity of draft cutting depend upon the values of $d_1/d_1$ (max) and dt/dt (max). To keep the frequency of stoppages of the machine to about once in ten hours, when using a widely used machine such as the "Turbo" stapler for polyacrylonitrile (acryl) fibers or the "Perlok" draft cutting machine it is necessary to satisfy the following conditions:

$$0.80 \leqq d_1/d_1(\max) \leqq 0.99 \quad (4)$$

$$0.65 \leqq dt/dt(\max) \leqq 0.95 \quad (5)$$

Accordingly, to manufacture uniform silver with high strength under a stabilized operational condition, the values of $d_1/d_1$ (max) and dt/dt (max) must be in the ranges expressed by the following formulas (6) and (7) which satisfy the formulas (1) to (5) all at the same time.

$$0.90 \leqq d_1/d_1(\max) \leqq 0.99 \quad (6)$$

$$0.85 \leqq dt/dt(\max) \leqq 0.95 \quad (7)$$

The elongation of sliver obtained by the above mentioned method is very small—only 9.5%; this contributes greatly to the uniformity of the slivers.

EXAMPLE 2

Ten 110,000-denier undrawn tows of polyester fibers were drawn simultaneously under the following conditions: first draw temperature=95° C.; first draw ratio 4.03, corresponding to 96% of the maximum first draw ratio; secondary draw ratio=1.475 times, this being 90% of the maximum total draw ratio; secondary draw temperature=170° C. The total tow was subsequently subjected to the draft cutting and amendatory draft cutting processes, thus obtaining sliver having a thickness of 2.07 g/m. The sliver obtained had high strength and excellent uniformity, a staple fiber strength of 7.5 g/d, and a sliver "I" factor of 3.71. The stoppage frequency of the draft cutting machine was only 0.5 time/10 hrs.

When, on the other hand, the secondary draw ratio was 1.362 and the maximum draw ratio was 98% of the maximum total draw ratio, all other conditions remaining the same, the resulting sliver had a very high strength of 8.04 g/d. However, it had excessive irregularities, the sliver "I" factor being 4.6. The operational efficiency was poor, the number of stoppages of the machine being 3.0 times/10 hrs.

The above mentioned sliver making process is best suited for, in particular, synthetic fiber tows made from polyesters.

In the next place, the further process step of fasciated yarn spinning according to the present invention will be described.

In the present invention, it is necessary, when supplying uniform draft-cut tow to the fasciated yarn spinning process, to provide an amendatory draft cutting step in order to create a staple material having a specially designed staple length distribution. This imparts strength to the resulting fasciated fiber yarns and ensures effective formation of wrapping fibers. By adjusting the gauge in the amendatory draft cutting zone, improved sliver of a special type is produced. It contains (when the mean length of all the component fibers is expressed by the symbol $\bar{l}$) more than 15% of fibers shorter than $0.4\times\bar{l}$ and more than 15% of fibers longer than $1.5\times\bar{l}$. This is an important factor in attaining the outstanding advantages of this invention.

As was previously stated, it is not always necessary to operate continuously from undrawn tow through the yarn-forming process, but it is also possible to start with drawn tow. Even when the operation is started with drawn tow, however, it is recommended that the drawing process as in the present invention be utilized to obtain uniform tow, and that such uniform tow be used.

Figure 8:
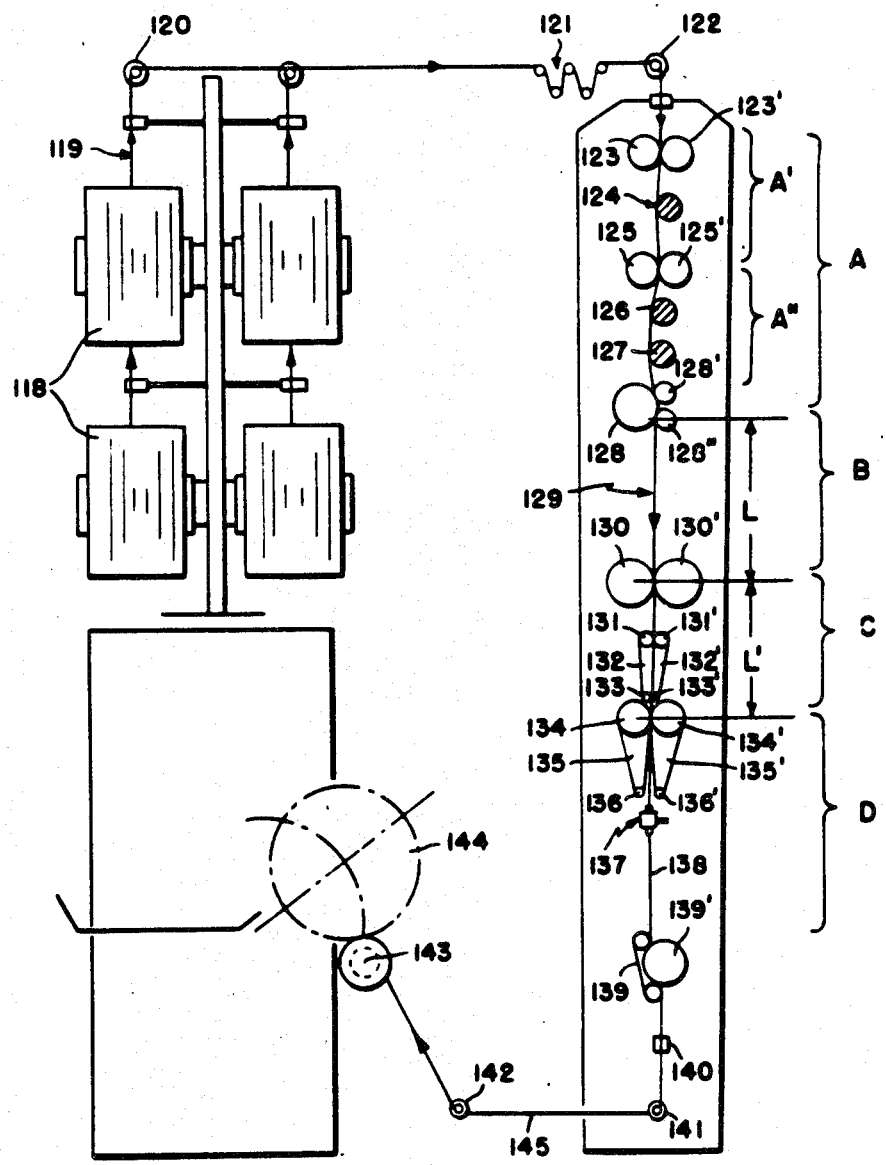
FIG. 8 is a schematic view in side elevation of another embodiment of the present invention.

With reference to FIG. 8, undrawn or partially drawn tow 119, from drums 118, is led by a guide 120 to a tow regulating bar 121 to a drawing zone "A" by feed rollers 123 and 123'. Drawing zone "A" consists of the first drawing zone A' having a heating pin 124, which is heated to above the second transition temperature of the polymer and the second drawing zone A" having a heat-drawing pin 126 and a heat-setting pin 127. Each pin 124, 126, 127 has a curvature of more than 5 mm in diameter and this permits uniform drawing with the fiber drawing points always arranged in a more or less straight line.

The drawn tow, which has been brought into the form of a uniform sheet by drawing, wherein there is minimum of thickness irregularities and all filaments are in a perfectly parallel condition without entangling with each other, is supplied to the draft cutting zone "B" without interruptions and in such a manner that the filaments do not come loose and that each filament remains undisturbed and remains in uniform configuration. Further, the tow does not undergo any appreciable change in width, along the path of its movement, but remains tense and under uniform tension. In said draft cutting zone "B", filaments are draft cut by draft cutting rollers 130 and 130' into staple. The draft cut staple is subjected to an amendatory draft cutting step by amendatory draw cutting rollers 134 and 134' in the amendatory draft cutting zone "C" which is directly connected to lead into the yarn forming zone. In this instance, the amendatory draft cutting zone length L' is, as was previously stated, set at 0.4 to 0.9 times of the upstream draft cutting zone length "L", and the amendatory draft cutting ratio is more than 2.5. In this way considerable quantities of both (a) long staple fibers which are effective for maintenance of the strength of yarn and (b) short staple fibers which are to become the wrapping fibers, are produced concurrently and effectively. The peripheral fibers which are short staple fibers intended to be disposed around the long fibers of the sliver are transmitted, without being disordered or blown off, by conveyor apron bands 135 and 135' for transmission of peripheral fibers which are driven by the amendatory draft cutting rollers 134 and 134' such an apron means acts as a peripheral fiber regulator. The peripheral fibers, together with other fibers of the bundle, are passed though diverging conveyor belts 135, 135' trained around drive rolls 134, 134' and 136, 136' and are false twisted by an air vortex nozzle 137 in the yarn forming zone "D", in a manner known pe se and described in detail in U.S. Pat. Nos. 3,978,648 and 4,003,194, for example, thus forming a fasciated fiber yarn 138 which is pulled out by delivery rollers 139, 139', passes through yarn break detector 140 and is passed about guide 141 where the resulting yarn 145 is passed about guide 142 and wound upon a package 144, through a rotary traverse drum 143.

In this instance, the bundle of fibers supplied to the draw cutting zone and amendatory draw cutting zones is in the shape of a sheet. Thickness irregularities are very few; there is virtually no intermingling of fibers; and the tension is maintained at a fixed level; hence, there seldom occurs a miscut owing to an abnormal distribution of breaking points in the draft cutting process. Consequently, the arising of peripheral fibers, namely, floating fibers, goes on smoothly; wrapping irregularities do not arise; nor do yarn breaks by fiber slippage under high tension. As well, such defects as variances in thickness of yarns produced—inclusion of thicker and thinner yarns in a lot—caused by an abnormal, concentrative arising of overlong fibers, is almost entirely eliminated. Thus, excellent fasciated fiber yarns having a high degree of uniformity are produced.

In FIG. 8, the cradle consisting of rollers 131–131' and 133–133', and aprons 132–132', have virtually no nip function. The numeral 122 indicates a stopper for the purposes of breaking the tow when a yarn break has been detected by a yarn break detecting means 140.

Figure 9:
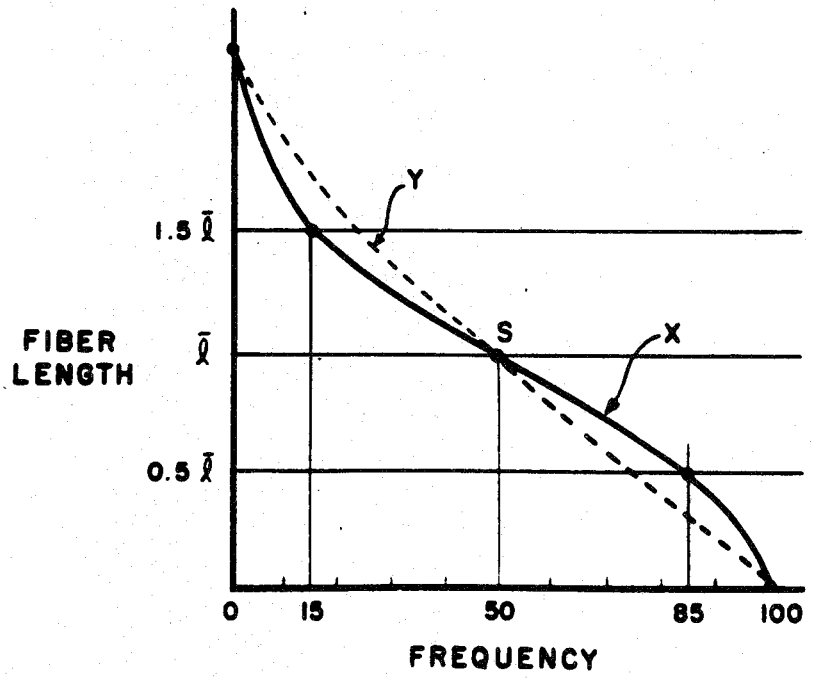
FIG. 9 is a graph showing a staple diagram of a sliver just before being fed into a yarn formation zone.

FIG. 9 shows the fiber length distribution of a typical fasciated fiber yarn thus obtained. It is the staple diagram of the silver immediately after it has come out of the amendatory draft cutting zone.

The greatest of the lengths of these fibers is close to L', the length of the amendatory draw cutting zone. Against the mean length of fibers $\bar{l}$, the diagram containing 15% each of fibers in lengths above $1.5\times\bar{l}$ and those in lengths below $0.5\times\bar{l}$ is indicated by the solid line X. The fasciated fiber yarn in accordance with the present invention is indicated by the dotted line Y lying above the solid line X in the region of greater fiber lengths and below it in the region of smaller fiber lengths, with the point "S" of the mean length of fiber $\bar{l}$ as the dividing point.

In this manner short wrapper fibers are effectively formed in combination with long core fibers. If the yarn should have a localized portion where the wrapper fibers somewhat lack in wrapping power, the strength of the yarn is sufficiently maintained by the long fibers in the core portion. Fasciated fiber yarns of this invention are, accordingly, as strong as ring spun yarn.

It is preferred to provide fibers in lengths greater than $1.5\times\bar{l}$ of about 15% to about 25%, and fibers in lengths less than $0.5\times\bar{l}$ of about 15% to about 20%.

Further, the mean length of fibers $\bar{l}$ is preferably about 50 to 500 mm, most preferably about 100 to 250 mm.

Figure 10:
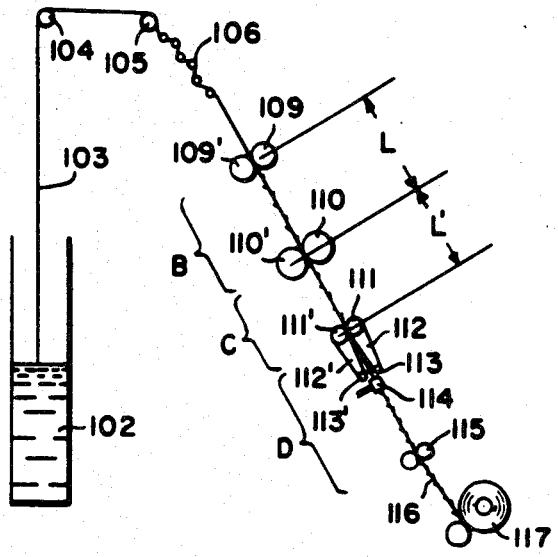
FIG. 10 is a schematic view in side elevation of another embodiment of the present invention.

FIG. 10 shows an example of the method of this invention wherein the operation is started with drawn tow. As tow 103, from a tow can 102, is drawn by a guide 104 it passes through a guide 105 and a set of two regulating bars 106 where it is processed to uniform thickness. Such tow is fed by feed rollers 109 and 109' to the draft cutting zone "B", with draft cutting rollers 110 and 110' which rotate faster than feed rollers 109 and 109' and then to amendatory draft cutting zone "C" wherein rollers 111, 111' rotate faster than rollers 110, 110' and thereafter through aprons 112, 112' to the yarn forming zone "D" provided with air vortex nozzle 113, 114. The conditions in each zone "C" and "D" above are about the same as in the case of FIG. 8. The yarn is passed through rollers 115 and the product 116 is wound up on winder 117.

Example 3

In a single stage amendatory draft cutting process as in FIG. 10, fasciated fiber yarns in a cotton count of 10S were made from drawn tow of polyester having a filament denier of 1.5. The draw cutting and yarn forming conditions, properties of the yarns obtained, and the results of yarn break tests (fiber slippage under high tension) are shown in Table 2.

Tests for yarn breakage were carried out on a winder. The figures given are the number of occurrences of yarn breakage per 100 kg of yarn when the yarn was rewound at a speed of 500 m/min., under a tension of 100 g.

The "overfeed ratio" is the percentage of decrease in speed of the deivery roller against that of the amendatory break draft roller.

When the ratio of the amendatory draft cutting zone length L' to the draft cutting zone length L (L'/L) was set at 0.5 and at 0.7 (Case I and II in Table 2), being in the range of the present invention, viz., 0.4 to 0.9, and the amendatory draft cutting ratio was set at 4.0, the composition of fiber lengths was $\bar{l}=110$ to 123 mm; fibers in lengths of more than $1.5\times\bar{l}=15\%$ to 20%; and fibers in lengths of less than $0.5\times\bar{l}=18\%$ to 16%. Thus, fasciated fiber yarns in accordance with the present invention were, although they were spun out at such a high speed as 100 m/min., as good as, or even superior to, the conventional ring spun yarn made by the woolen or worsted system in all respects of average strength, minimum strength, coefficient of variation of strength and yarn breakage by fiber slippage under high tension. Also, as compared with a fasciated fiber yarn obtained by the method of the Japanese Patent Publication No. 52-43256, which involves conventional silver usage, the strength of the yarn in accordance with the present invention was greater and, in addition, there were less strength variances. The frequency of yarn breakage of yarn according to this invention was only $\frac{1}{3}$ to $\frac{1}{2}$ that of the conventionally made yarn.

On the other hand, in cases III and IV of Table 2, which are outside the present invention, when the ratio L'/L becomes smaller, there is an increase in the number of fibers to be draft cut in the amendatory draft cutting zone, and this gives rise to problems since draw cutting irregularities arise owing to miscuts; the coefficient of variation of strength becomes larger; sufficient floating fibers are not produced; and there is a great decrease in the content of fibers shorter than $0.5\times\bar{l}$. This increases the frequency of yarn breakage by fiber slippage.

When the L'/L ratio exceeds 0.9, the actual value in this example being 0.92, the amendatory draft cutting zone length for amending the length of fibers becomes inadequate and an excessive amount of floating fibers is produced; there is an increase in yarn irregularities owing to amendatory draw cutting irregularities; the strength fluctuation rate becomes larger and the average strength value becomes lower.

Although not shown in Table 2, when the amendatory draft cutting ratio was less than 2.5, yarn breakage by fiber slippage owing to poor wrapping was often found, irrespective of the value of L'/L.

TABLE 2

| | | | | | | Ordinary yarn | |
|---|---|---|---|---|---|---|---|
| | | I | II | III | IV | Ring Spun | Fasciated yarn |
| Conditions of break draft cutting and yarn formation | Supplied tow (denier:D) | 6000 | 6000 | 6000 | 6000 | | |
| | L'/L | 0.5 | 0.7 | 0.3 | 0.92 | | |
| | Draft ratio of amendatory draft cutting | 4.0 | 4.0 | 3.5 | 4.0 | | |
| | Over feed ratio (%) | 6 | 6 | 6 | 6 | | |
| | Yarn speed (M/min) | 100 | 100 | 100 | 100 | | |
| Yarn characteristics | Yarn count Ne (cotton number) | 10.0 | 10.0 | 10.0 | 10.0 | 10.0 | 10.1 |
| | Average strength (kg) | 2.32 | 2.29 | 1.58 | 2.03 | 2.26 | 2.11 |
| | Maximum strength (kg) | 2.52 | 2.59 | 2.30 | 2.43 | 2.50 | 2.60 |
| | Minimum strength (kg) | 2.08 | 1.97 | 0.95 | 1.86 | 2.03 | 2.03 |
| | Coefficient of variation of strength (%) | 9.4 | 9.9 | 18.4 | 11.3 | 9.7 | 10.8 |
| | Tenacity (g/d) | 4.30 | 4.23 | 2.99 | 4.01 | 4.28 | 3.97 |
| Test of yarn breakage by slippage | Frequency of yarn breakages per 100 kg. | 3 | 2 | 34 | 17 | 3 | 8 |

Example 4

As shown in FIG. 10, a drawn nylon tow of 25,000 denier, 3 d.p.f. was draw cut and subjected to amendatory draft cutting. The amendatory draft cutting zone length was 0.60 times the draft cutting zone length. The product was formed into a yarn at an overfeed ratio of 5.6%, thus obtaining a fasciated fiber yarn. The amendatory draft cutting ratio in the amendatory draft cutting zone was set at 4.2. The distribution of fiber lengths of the silver as it came out of the amendatory draft cutting zone was: mean length of fibers $\bar{l}=108$ mm; fibers in lengths of more than $1.5\times\bar{l}=18.2\%$; and fibers in lengths of less than $0.5\times\bar{l}=16.7\%$.

On the other hand, using nylon staples in lengths of 102 mm, 3.0 d.p.f.; a nylon spun yarn of 10.0'S was obtained by the conventional ring spinning process.

Table 3 shows a comparison of yarn properties.

Against a strength of 3.76 g/d and a coefficient of variation of strength of 7.9% of the conventional ring spun yarn, the fasciated fiber yarn of the present invention had a strength of 3.86 g/d and a coefficient of variation of strength of 8.0%. This is about the same level as conventional ring spun yarn.

On the other hand, in a rewinding operation under a tension of 100 g, the frequency of yarn breakage by fiber slippage was 3 times per 100 kg of rewound yarn in the conventional yarn, while it was only 2 times in the yarn of this invention.

Further, with a fasciated fiber yarn using conventional staple, it was necessary to prevent excessive yarn breakage by fiber slippage to set the overfeed ratio at as large as 8%. But when this was done, the yarn presented a poor appearance due to shrinkage owing to twisting effect of fasciated fibers, and there was an average strength reduction of 10 to 20%.

Also, when the ratio L'/L was set at 0.95 or at 0.35, excessive yarn irregularities were found in the fasciated fiber yarn obtained, the Uster evenness U% being as high as more than 20%; hence, the yarn was unfit for practical use. Furthermore, when the amendatory draft cutting ratio was set at less than 2.5, though fibers in lengths of more than $1.5\times\bar{l}$ increased to more than 20% of the total, fibers in lengths of less than $0.5\times\bar{l}$ decreased to about 10% or less; also, the number of floating fibers produced was not sufficient and the yarn obtained had a tendency toward yarn breakage by fiber slippage.

TABLE 3

| | Yarn of the invention | Yarn spun by ring twister |
|---|---|---|
| Yarn count (metric number) | 10.28 | 10.08 |
| Average strength (kg) | 3.40 | 3.38 |
| Maximum strength (kg) | 3.83 | 3.80 |
| Minimum strength (kg) | 3.05 | 3.10 |
| Coefficient of variation of strength (%) | 8.0 | 7.9 |
| Tenacity (g/d) | 3.86 | 3.76 |
| Uster unevenness (%) | 11.3 | 13.1 |
| Yarn breakage frequency (breaks/100 kg) | 2 | 3 |

Example 5

Figure 11:
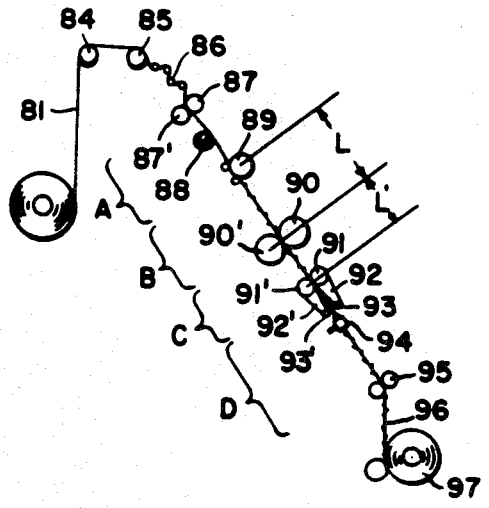
FIG. 11 is a schematic view in side elevation showing another embodiment of the present invention.

In single stage drawing as in FIG. 11, undrawn 6700 denier polyester two having a natural draw ratio of 3.0 was supplied as a material 81 and was drawn at a draw ratio of 2.8 in the draw zone "A" having draw rolls 87, 87' 89 and a heat pin 88 (O.D.=60 mm) heated to a temperature of 90° C. The drawn tow was supplied to the draft cutting zone "B" having rolls 90, 90' in such a manner that it retained its uniform sheet-like form after drawing; its width was not appreciably reduced and it remained tense after drawing. It was drawn cut at a ratio of 2.5 into staple. Subsequently, it was subjected to an amendatory draft cut in the amendatory draft cutting zone "C" having rolls 91, 91', whose zone length was 0.55 times that of the draft cutting zone, at an amendatory draft cut ratio of 3.8. It was continuously passed through diverging aprons 92, 92' and false-twisted by an air vortex device 94 of the type used in fasciated yarn spinning processes. At an overfeed ratio of 5.0% and at a spinning speed of 110 m/min., a fasciated fiber yarn (I) in a cotton count of 20'S, according to the present invention, and starting with undrawn tow, was obtained. The yarn 96 was passed through rollers 95 and wound on winder 97.

Figure 12:
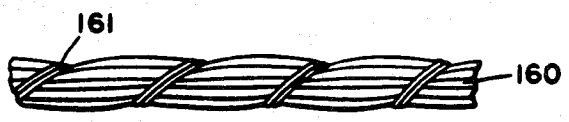
FIG. 12 is a schematic view in side elevation of a fasciated yarn according to the present invention.

FIG. 12 shows an enlarged portion of a typical fasciated yarn according to this invention, having long core fibers 160 arranged in a bundle and having a plurality of uniformly wound wrapper fibers 161.

Table 4 shows the yarn properties of the foregoing example including (I), a fasciated fiber yarn and (II) yarn according to the present invention which was made by supplying a drawn tow of 3400 denier to the draft cutting zone, other conditions remaining the same as (I), and a polyester spun yarn with a fiber denier of 1.5, made by the conventional ring spinning process.

The yarns (I) and (II) in accordance with the present invention had average strengths of 1150 g and a coefficient of variation of strength of 8.8%, and were equal to or even superior to conventional ring spun yarn.

In tests conducted by rewinding yarns at 500 m/min. and under a tension of 100 g, the yarn breakage frequency by fiber slippage, per 100 kg of yarn rewound, was 3.1 times in the conventional ring spun yarn and 2.0 times in the fasciated fiber yarn (II). This frequency was zero in the fasciated fiber yarn (I) made from undrawn tow. Thus, the yarn (I) was quite excellent in this respect, problems of yarn breakage by fiber slippage under high tension having been completely eliminated.

Further, while the Uster evenness U% of the conventional ring spun yarn of 20'S was 9.9%, that of the fasciated fiber yarn from drawn tow had a superior value of 9.5%. The I factor (the ratio of theoretical yarn irregularities to measured yarn irregularities), which represents the degree of evenness with short fiber thickness taken into account, was 1.64 with the conventional ring spun yarn and 1.60 with the fasciated fiber yarn made from drawn tow while that of the fasciated fiber yarn made from undrawn tow was 1.52. Thus, in respect of yarn irregularities too, the fasciated fiber yarns were better than the conventional ring spun yarn; and further, the fasciated fiber yarn made from undrawn tow was superior to the fasciated fiber yarn made from drawn tow.

The fasciated fiber yarn (I) of the present invention had 19.3% fibers longer than $1.5\times\bar{l}$ and 16.1% fibers shorter than $0.5\times\bar{l}$.

When the amendatory draw cutting gauge was outside the range of 0.4 to 0.9 times, more yarn breakage by fiber slippage occurred. Also, there were more yarn irregularities, the "I" factor exceeding 1.70. When the amendatory draw cutting ratio was less than 2.5 the coefficient of variation of yarn strength exceeded 15% and yarn breakage by fiber slippage requently occurred. The yarns produced could hardly be said to be fit for practical use.

TABLE 4

| | (I) | (II) | Yarn spun by ring twister |
|---|---|---|---|
| Yarn count (cotton number) | 20.0 | 20.1 | 20.0 |
| Average strength (kg) | 1150 | 1130 | 1145 |
| Coefficient of variation of strength (%) | 8.8 | 8.9 | 8.7 |

TABLE 4-continued

| | (I) | (II) | Yarn spun by ring twister |
|---|---|---|---|
| Tenacity (g/d) | 4.35 | 4.30 | 4.32 |
| Elongation (%) | 12.0 | 14.0 | 14.5 |
| Uster unevenness (%) | 9.5 | 9.7 | 9.9 |
| Yarn I factor | 1.52 | 1.60 | 1.64 |
| Yarn breakage frequency (Breaks/100 kg) | 0 | 2.0 | 3.1 |

Example 6

Using equipment as shown in FIG. 8, a fasciated fiber yarn was manufactured by supplying an undrawn polyester tow of 20,000 denier.

The primary drawing was carried out under the following conditions: first draw ratio $d_1=3.17$ (98% of the max. first draw ratio); and first draw temperature $T_1=90°$ C. The drawing line fluctuation range was kept within 3 mm. The secondary draw was carried out under the following conditions: secondary draw ratio $d_2=1.36$ (total draw ratio dt=96% of the max. draw ratio dt(max)); secondary draw temperature $T_2=185°$ C.; and heat-setting temperature $T_2=195°$ C. It was found possible to draw with the drawing points maintained within a range of 2 mm width. The drawn tow was draft cut in the draft cutting zone, and was then subjected to amendatory draft cutting at a ratio of 5.10. The resulting sliver was spun at 200 m/min., and a fasciated fiber yarn of 20.0'S was obtained. In this instance L'/L is 0.66. The mean length of fibers from the amendatory draft cutting zone was $\bar{l}=122$ mm; 19.3% of the fibers had lengths of more than 1.5. 15.4% were shorter than $0.5\times\bar{l}$. The fibers of this bundle had very great strength, the staple fiber strength being 7.2 g/d.

The yarn of 20.0'S obtained had excellent uniformity in spite of its extra high strength. Its Uster evenness U% was 11.3%. In addition, yarn breakage by fiber slippage under high tension was only rarely encountered. Thus, the yarn was of very high quality.

When L'/L was 0.95, the content of fibers shorter than $0.5\times\bar{l}$ was only 10.0%, and in a rewind test at a speed of 500 m/min. and under a tension of 100 g, yarn breakage by fiber slippage occurred at a rate of 5–10 times/kg.

In the case where L'/L was 0.3 too, the mean length of the fibers came to 62 mm and only 9.9% of fibers were shorter than $0.5\times\bar{l}$. The number of occurrences of yarn breakage by fiber slippage was very large, being twice as large as that in the case where L'/L was 0.95.

When on the other hand, the primary draw ratio was: $d_1=2.58$ times (80% of $d_1$(max)), fibers longer than $1.5\times\bar{l}$ and those shorter than $0.5\times\bar{l}$ were respectively 16.3% and 15.0%, and the yarn was free of yarn breakage by fiber slippage under high tension. It was impossible, however, to obtain high strength staple fiber, the strength of the staple fiber obtained being only 4.8 g/d.

Example 7

Using the equipment of FIG. 8, a fasciated fiber yarn was manufactured by supplying 15,000 denier undrawn nylon tow.

The draw ratio in the first draw zone $d_1$ was 3.61; ($d_1$/dt(max)=0.90); the heat pin temperature $T_1$ was 100° C.; the draw ratio in the secondary drawing zone $d_2$ was 1.05; the heating pin temperature $T_2$ was 150° C.; and the heat-setting pin temperature $T_s$ was 180° C. The drawing points were held within a range of 2 mm in width in both of the draw zones, and it was possible to carry out uniform drawing.

This drawn tow was drawn cut and subjected to amendatory draft cutting at a ratio of 3.9. L'/L was 0.75 times. The staple was subsequently spun as a yarn of 30.5'S with a fiber denier of 2.2.

The bundle of fibers as it came out of the amendatory draft cutting zone had a mean fiber length of 133 mm, and contained 20.3% fibers longer than $1.5\times\bar{l}$ and 15.3% of fibers shorter than $0.5\times\bar{l}$. The yarn obtained had a strength of 625 g, a coefficient of variation of strength of 12.9 and an Uster evenness U% of 14.5%. Thus, a nylon yarn of high quality was obtained, as was the case with polyester.

When nylon yarn was spun by ring spinning on the other hand, spinnability was rather poor and excessive neps arose. Hence, it was difficult to spin yarns of a higher count, such as 30'S; in addition, serious yarn irregularities arose. The product was not fit for practical use.

When, in the present method, the amendatory draft cutting ratio was below 2.5 unsatisfactory wrapping occurred. Quite a number of yarn breaks occurred by reason of fiber slippage under high tension. Furthermore, when L'/L was 0.95 or 0.35 many yarn breaks by fiber slippage also occurred and the yarn strength was only 461 g.

We claim:

1. A process for making a fasciated yarn from a tow of fibers, the steps which comprise subjecting the tow to a drawing step, wherein the tow is drawn over a heater and the draw points of the fibers of the tow are substantially located over said heater in an essentially elongated area having a narrow width, draft cutting the tow, subjecting the draft cut fibers to at least one amendatory draft cutting step and subjecting the resulting fibers to a yarn formation step, wherein the fibers are continuously transferred from said drawing step to said yarn formation step without any substantial interruption of fiber movement between said steps.

2. The process defined in claim 1 wherein the amendatory draft cutting step is performed while maintaining an amendatory draft cutting ratio upstream of the yarn formation step of more than about 2.5.

3. The process defined in claim 1 including the further step of controlling the length of the zone in which said amendatory draft cutting occurs at about 0.4 times to 0.9 times of the drafting zone length just upstream of said amendatory draft cutting step.

4. The process of claim 1, in which a synthetic fiber tow is provided to said draft cutting step and is uniform.

5. The process of claim 4, wherein said draft cutting step is applied to a synthetic fiber tow under such conditions that the sliver produced by said draft cutting step has a sliver I factor of less than about 4.0.

6. The process of claim 4, wherein the drafted tow is produced by drawing a uniform tow selected from the group consisting of undrawn synthetic filaments and partially drawn synthetic filaments.

7. The process of claim 6, wherein the fiber group provided is continuously transferred from the drawing step through the amendatory draft cutting step to the yarn formation step without any substantial interruption of its movement.

8. The process of claim 6, wherein the drawing step is conducted by drawing a tow to produce a uniform draft cut sliver having a sliver I factor of less than about 4.0 by drafting said tow under such conditions that the points of all the filaments of said tow are substantially disposed in a straight line having a narrow width, followed by the step of transferring the drawn tow to an adjacent draft cutting step without any substantial interruption of its movement therebetween.

9. The process of claim 4, in which a tow selected from the group consisting of undrawn tow and partially drawn tow is reduced to a uniform sliver by drawing said tow under such conditions that the drawing points of all filaments of the tow are substantially disposed in a straight line having a narrow width, and said uniform sliver is fed to said draft cutting step.

10. The process of claim 9, wherein the tow is formed in at least two separate drawing steps.

11. The process of claim 10, wherein the drawing points of all filaments of the tow are maintained substantially disposed in a straight line having a narrow width in each of said drawing steps.

12. The process of claim 10, including the steps of heating and drawing the tow in one such drawing step and heating and drawing and stretch-heat-treating the tow in another such drawing step.

13. The process of claim 12, including the steps of drawing the synthetic fiber tow in one such drawing step under such conditions that the temperature of said heating step is between about 100° C. and 140° C. and the draw ratio is between about 85% and 95% of the maximum draw ratio at which a uniform drawing operation can be performed, and drawing said tow in another drawing step having two heating steps under such conditions that said tow is drawn at a draw ratio less than about 1.2 at a temperature of about 130° C.–170° C. and heat treating under a stretched condition at a temperature of about 170° C.–230° C., and subsequently draft cutting the resulting drawn tow without any substantial interruption of its movement.

14. The process of claim 13, in which the synthetic fiber tow consists essentially of polyester fibers.

15. The process of claim 13, in which the synthetic fiber tow consists essentially of polyamide fibers.

16. The process of claim 10, wherein the step of drawing said tow in one such step is conducted at a draw ratio of 90–99% of the maximum draw ratio in said drawing step under which a uniform drafting operation can be performed, drawing said tow in another drawing step at such a draw ratio that the total draw ratio which is the product of the draw ratio of said one draw step and that of said other draw step is about 85–90% of the maximum total draw ratio, and draft cutting said drawn tow in an adjacent draft cutting zone without any substantial interruption of its movement.

17. The process of claim 9 including the step of locally heating said tow on a curved contact point in at least one said drawing step.

18. The process of claim 17, wherein the drawing points of all the filaments of the tow are substantially disposed around a contact point of the fibers of the tow with the curved surface of a heating device, in substantially the form of a line.

19. The process of claim 1, wherein $\bar{l}$ designates the average fiber length of the fiberrs of the draft cut sliver produced by said amendatory draft cutting step, and wherein more than 15% of the fibers of said sliver have a fiber length more than 1.5 $\bar{l}$, and wherein more than 15% of all fibers of said sliver have a fiber length less than 0.5 $\bar{l}$.

20. The process of claim 19, wherein said sliver is spun in said yarn formation step under such conditions that the fibers having a fiber length more than 1.5 $\bar{l}$ are mainly disposed in the core portion of the yarn and the fibers having a fiber length less than 0.5 $\bar{l}$, are mainly disposed as wrapper fibers around said core.

21. The process of claim 1 or 20, including the steps of providing an air eddy current in said yarn formation step, and taking up and twisting the draft cut sliver by the action of said air subsequently to said amendatory draft cutting step.

22. The process of claim 1 or 20 wherein said formation step consists of twisting said sliver under the influence of air fluid flow with an eddy current, creating wrapper fibers and wrapping them around said core fibers.

23. In an apparatus for making a fasciated yarn from a tow of fibers, the combination which comprises drawing means for making a uniform drawn tow, including heater means and means for drawing said two with draw points of the filaments of the tow substantially on said heater means in an elongated area having a narrow width, a draft cutting zone comprising spaced sets of rolls through which said tow from said drawing means is conducted for subjecting the fibers to a draft cutting step, means forming a further draft cutting zone downstream of the aforesaid zone for subjecting the draft cut fibers to at least one amendatory draft cutting step, and a yarn forming means downstream of said amendatory draft cutting zone for subjecting the resulting fibers to a yarn formation step, and transfer means between said zones whereby the fibers are continuously transferred from said draft cutting zone to said yarn formation zone without any substantial interruption of fiber movement between said zones.

24. The apparatus defined in claim 23, wherein the amendatory draft cutting zone comprises spaced upstream and downstream draft cutting rolls, and wherein drive means is provided for driving said downstream rolls much faster than said upstream rolls to maintain an amendatory draft cutting ratio upstream of the yarn formation zone of more than about 2.5.

25. The apparatus defined in claim 23, wherein the length of the amendatory draft cutting zone is about 0.4 times to 0.9 times the drafting zone length just upstream of said amendatory draft cutting zone.

26. The apparatus of claim 23, further including a draw zone upstream of said draft cutting zone, wherein said draw zone includes localized heating means applied to a synthetic fiber tow to cause localized fiber drawing along a restricted elongated substantially straight area.

27. The apparatus of claim 26, wherein means are provided for moving the fiber group continuously from the drawing zone through the draft cutting zone and through the amendatory draft cutting zone to the yarn formation zone without any substantial interruption of its movement.

28. The apparatus of claim 26, wherein said draw zone comprises an upstream draw zone and a downstream draw zone, whereby the tow is formed in at least two separate drawing zones.

29. The apparatus of claim 28, wherein draw heaters are provided for locally heating the tow in each of said upstream and downstream draw zones, whereby the drawing points of all filaments of the tow are maintained substantially disposed in a straight line having a narrow width in each of said upstream and downstream draw zones.

30. The apparatus of claim 28, including means for heating and drawing the tow in one such drawing zone and means for heating and drawing and stretch-heat-treating the tow in another such drawing zone.

31. The apparatus of claim 28, including means for drawing the synthetic fiber tow in one such drawing zone at a draw ratio of about 85% and 95% of the maximum draw ratio at which a uniform drawing operation can be performed, and subsequent means for drawing said tow in said other drawing zone having two heating means at a draw ratio less than about 1.2 and means for heat treating said tow thereafter under a stretched condition.

32. The apparatus of claim 26, wherein said localized heating means has a curved surface for locally heating said tow on a curved contact point in said drawing zone.

33. The apparatus of claim 32, wherein said heating means extends across the tow in a substantially straight line, whereby the drawing points of all the filaments of the tow are substantially disposed around a contact point of the fibers of the tow with the curved surface of the heating means in substantially the form of a line.

34. The apparatus of claim 23, wherein said yarn forming zone includes means for providing an air eddy current in said yarn formation zone, and means for taking up and twisting the draft cut sliver by the action of said air subsequently to said amendatory draft cutting step.

35. The apparatus of claim 23, wherein said formation zone includes means for twisting said sliver under the influence of air fluid flow with an eddy current whereby wrapper fibers are wrapped around said core fibers.

36. In a process for making draft cut sliver from tow, the steps which comprise subjecting the tow to a draft cutting step and subjecting the draft cut fibers to at least one amendatory draft cutting step wherein the amendatory draft cutting step is performed while maintaining an amendatory draft cutting ratio of more than about 2.5, wherein the drafted tow is a drafted tow produced by drawing a uniform tow selected from the group consisting of undrawn synthetic filaments and partially drawn synthetic filaments, and wherein the drawing step is conducted by drawing a tow to produce a uniform draft cut sliver having a sliver I factor of less than about 4.0 by drafting said tow under such conditions that the drawing points of all the filaments of said tow are substantially disposed in a straight line having a narrow width, followed by the step of transferring the drawn tow to an adjacent draft cutting step without any substantial interruption of its movement therebetween.

37. In a process for making draft cut sliver from tow, the steps which comprise subjecting the tow to a draft cutting step and subjecting the draft cut fibers to at least one amendatory draft cutting step wherein the amendatory draft cutting step is performed while maintaining an amendatory draft cutting ratio of more than about 2.5, wherein the drafted tow is a drafted tow produced by drawing a uniform tow selected from the group consisting of undrawn synthetic filaments and partially drawn synthetic filaments, including the steps of heating and drawing the tow in one such drawing step and heating and drawing and stretch-heat-treating the tow in another such drawing step, and including the steps of providing polyamide or polyethylene terephthalate tow, of drawing said tow in one such drawing step under such conditions that the temperature of said heating step is between about 100° C. and 140° C. and the draw ratio is between about 85% and 95% of the maximum draw ratio at which a uniform drawing operation can be performed, and drawing said tow in another drawing step having two heating steps under such conditions that said tow is drawn at a draw ratio less than about 1.2 at a temperature of about 130° C.–170° C. and heat treating under a stretched condition at a temperature of about 170° C.–230° C.

38. The process of claim 36 wherein the drawing points of all the filaments of the tow are substantially disposed around a contact point of the fibers of the tow with the curved surface of a heating device, in substantially the form of a line.

* * * * *